United States Patent [19]

Chen

[11] Patent Number: 5,039,096

[45] Date of Patent: Aug. 13, 1991

[54] SHOCK ABSORBING RACKET

[76] Inventor: Dennis Chen, 293 Pei Tun Road, Taichung, Taiwan

[21] Appl. No.: 517,825

[22] Filed: May 2, 1990

[51] Int. Cl.[5] ..... A63B 49/06

[52] U.S. Cl. ..... 273/73 G; 273/73 J

[58] Field of Search ..... 273/73 R, 73 C, 73 G, 273/73 J, 75

[56] References Cited

U.S. PATENT DOCUMENTS

| | | | |
|---|---|---|---|
| 4,293,130 | 10/1981 | Beranek | 273/73 R |
| 4,627,635 | 12/1986 | Koleda | 273/73 J X |
| 4,660,832 | 4/1987 | Shomo | 273/73 J |
| 4,875,679 | 10/1989 | Movilliat | 273/73 R |
| 4,907,810 | 3/1990 | Whiteford | 273/73 J |

FOREIGN PATENT DOCUMENTS

| | | | |
|---|---|---|---|
| 17012 | of 1929 | Australia | 273/75 |
| 2724652 | 12/1978 | Fed. Rep. of Germany | 273/73 R |
| 3341256 | 5/1985 | Fed. Rep. of Germany | 273/73 J |

*Primary Examiner*—Edward M. Coven
*Assistant Examiner*—William E. Stoll

[57] ABSTRACT

A shock absorbing racket comprises a head frame, two connecting protrusions, a yoke portion, and a handle. Extending outwardly from the bottom of the head frame, two connecting protrusions integrate with the yoke portion. The racket handle has a portion adjacent the juncture which is defined as the yoke portion. Respective to each other, two pairs of grooves are disposed around the outer peripheries of the two connecting protrusions at a suitable distance adjacent the juncture. Two recesses are disposed around the outer periphery of the yoke portion. The handle is wrapped by a shock absorbing band. Each recess is enclosed by an elastic shock absorbing member respectively. Each groove is tied by a shock absorbing fillet respectively.

1 Claim, 2 Drawing Sheets

SHOCK ABSORBING RACKET

BACKGROUND OF THE INVENTION

The present invention relates to a racket for tennis or similar games, and is particularly concerned to provide a shock absorbing racket.

In all athletic injuries, "tennis elbow" could be the most easily to discover in the tennis game which is caused by shock transmitting through the racket handle to the player's hand and wrist while striking a ball. Accordingly, the frame structure of a commercialized racket is generally made in a single-piece construction. More particularly, the racket handle is usually integral with the head of a racket. Therefore, the shock is transmitted from the network of a racket while striking a ball. Due to the shock directly transmits to the player's wrist, thus the player may frequently feel his hand paralyzed. Subsequently, such shock will injure the user's elbow to cause "tennis elbow". Some manufacturers have tried to attach shock-absorbing strips or the like to make a web of catgut to absorb shock. However, the shock absorbing effect is not satisfactory, and it is even more difficult to control the racket.

SUMMARY OF THE INVENTION

The object of the present invention is to provide a shock absorbing racket which is able to greatly reduce shock causing by striking a ball so as to efficiently avoid injuring.

To accomplish the above object, a racket in accordance with the present invention comprises a head frame, two connecting protrusions, a yoke portion, and a handle. The connecting protrusions extending from the bottom of the head frame, have its rear ends connecting to the racket handle, integral with the racket handle. A plurality of grooves are respectively formed on the two connecting protrusions and at the front edge of the racket handle at the predetermined positions. The recesses are formed in the yoke portion. By this means, shock will be absorbed while the racket is struck by a ball.

DETAILED DESCRIPTION OF THE PREFERRED EMBODIMENT

Figure 1:
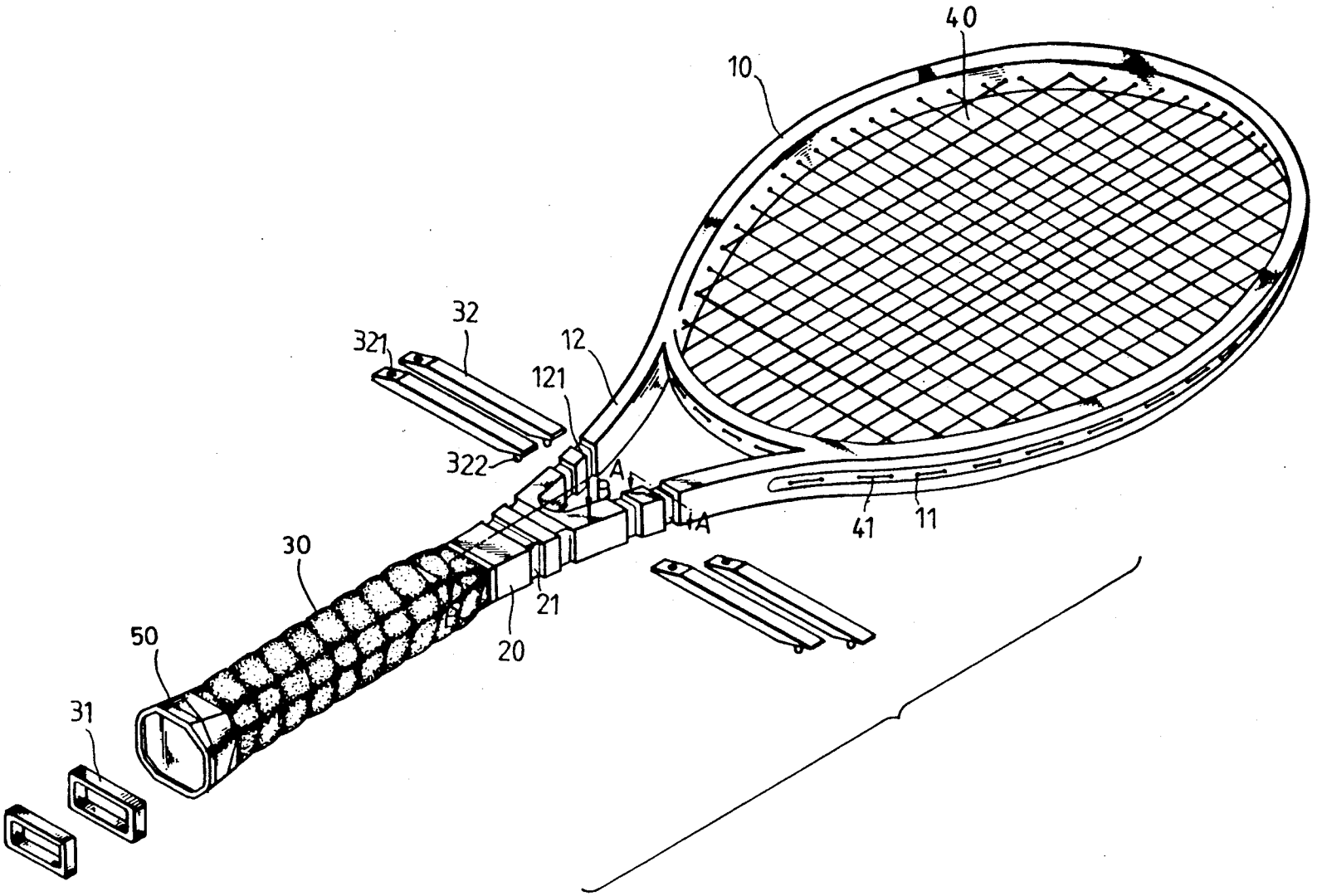
FIG. 1 is a schematic perspective view of a racket embodying the present invention.

Referring to FIG. 1, the shock absorbing racket comprises a head frame, 10 two connecting protrusions 12, a yoke portion 20, and a handle 50. The head frame 10 is in an oval shape, having around its periphery a plurality of thread holes 11 for strings 41 passing therethrough to form a criss-crossing network 40 of strings

41. A pair of connecting protrusions 12 which are integral with the yoke portion 20 are extending outwardly from the bottom of the head frame 10. The yoke portion 20 are integrally disposed between the connecting protrusions 12 and the handle 50. A pair of grooves 121 are respectively formed around the outer periphery of each connecting protrusion 12 and are respective to each other at a suitable distance. Two recesses 21 are disposed around the outer periphery of the yoke portion 20 and are respective to each other at a suitable distance.

Figure 2:
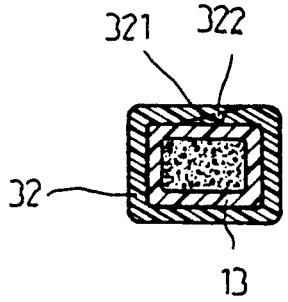
FIG. 2 is a cross-sectional view taken on line A—A of FIG. 1.
Figure 3:
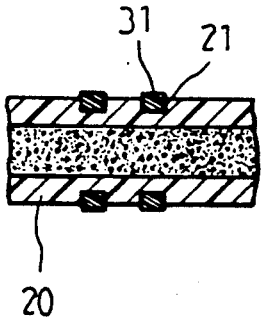
FIG. 3 is a cross-sectional view taken on line B—B of FIG. 1.

Referring to FIGS. 1 to 3, the handle 50 is wrapped by a shock absorbing band 30. Each of the recesses 21 is enclosed by each of elastic shock absorbing members 31 respectively. Each of the four grooves 121 is tied by a shock absorbing fillet 32 which has a locking hole 321 at one end and a locking protrusion 322 at an opposite end. The four shock absorbing fillets 32 are respectively fastened to the corresponding grooves 121 by bending each fillet 32 and inserting the locking protrusion 322 into its own locking holes 321. Therefore, the recesses 21 are formed in the yoke portion 20 and the grooves 121 are formed in the connecting protrusions 12. Furthermore, the yoke portion 20 and the two connecting protrusions 12 are disposed between the handle 50 and the bottom of the head frame 10.

When the racket is hit by a ball, the shock will be transmitted from the strings 41 to the head frame 10, then to the two connecting protrusions 12, then to the yoke portion 20, and to the handle 50. The center portion of a racket is approximately at the bottom of the head frame 10. If the shock is stopped or reduced at the connecting protrusions 12 and the yoke portion 20, the handle 50 will receive very little shock. Since the shockwave is transmitted through a straight line, the recesses 21 and grooves 121 can damp the shock transmission from the strings 41 to the handle 50.

I claim:

1. A shock absorbing racket comprising:

a head frame with a plurality of thread holes around the periphery of said head frame;

a pair of connecting protrusions extending outwardly from the bottom of said head frame;

a yoke portion integrally connected with said two connecting protrusions;

a handle integrally connected with said yoke portion;

said yoke portion formed between said connecting protrusions and said handle;

a pair of grooves formed around the outer peripheries of each of said two connecting protrusions;

two recesses formed around the outer periphery of said yoke portion;

said handle wrapped by a shock absorbing band;

each of said recess enclosed by an elastic shock absorbing member;

each of said groove tied by a shock absorbing fillet having a locking hole at one end and a locking protrusion at an opposite end;

said locking protrusion insertable in said locking hole.

* * * * *